United States Patent [19]

Le Devehat

[11] 4,416,306

[45] Nov. 22, 1983

[54] METHOD AND APPARATUS FOR CONTROLLING ARTICULATED FLUID LOADING ARMS UPON EMERGENCY DISCONNECTION

[75] Inventor: Eugene R. Le Devehat, Sens, France

[73] Assignee: FMC Corporation, Chicago, Ill.

[21] Appl. No.: 289,739

[22] Filed: Aug. 3, 1981

[30] Foreign Application Priority Data

Aug. 4, 1980 [FR] France ..... 80 17184

[51] Int. Cl.[3] ..... B63B 35/44

[52] U.S. Cl. ..... 137/615; 141/387

[58] Field of Search ..... 137/615; 141/387

[56] References Cited

U.S. PATENT DOCUMENTS

| | | | |
|---|---|---|---|
| 3,340,907 | 9/1967 | Bily | 137/615 |
| 3,455,333 | 7/1969 | Bily | 137/615 |
| 3,581,769 | 6/1971 | Haley | 137/615 |
| 4,190,080 | 2/1980 | Le Devehat | 137/615 |

*Primary Examiner*—A. Michael Chambers

*Attorney, Agent, or Firm*—W. William Ritt, Jr.; Richard B. Megley

[57] ABSTRACT

An articulated marine fluid loading arm comprising rigid, pivotally-interconnected inner and outer arm members with the inner arm member pivotally mounted on an upstanding riser for movement about horizontal and vertical axes, and a system for controlling the arm during emergency disconnection thereof from a tanker or other marine vessel. The system includes an auxiliary counterweight movably mounted on a support beam that is fixed to, and extends rearwardly from, the riser end of the inner arm member, and a hydromechanical system for automatically adjusting the position of the auxiliary counterweight between that wherein the loading arm is substantially balanced in an empty condition and that wherein the arm is substantially balanced in a fluid-filled condition.

17 Claims, 12 Drawing Figures

FIG_8
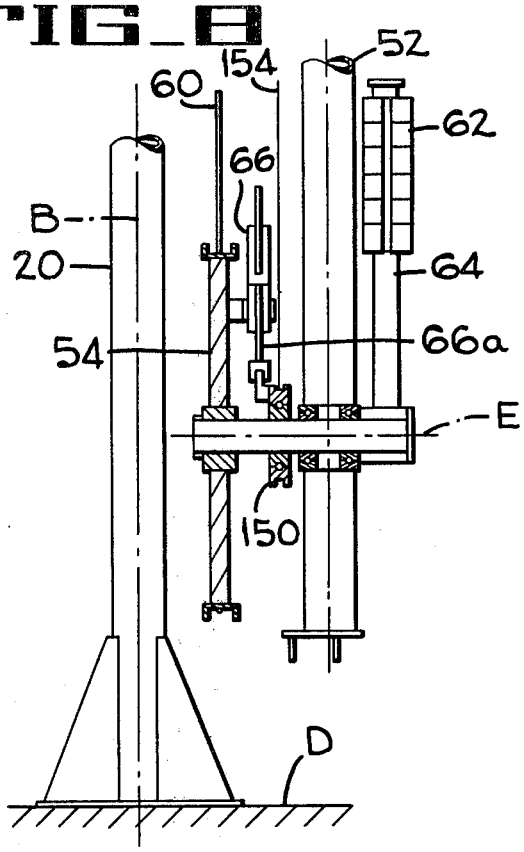
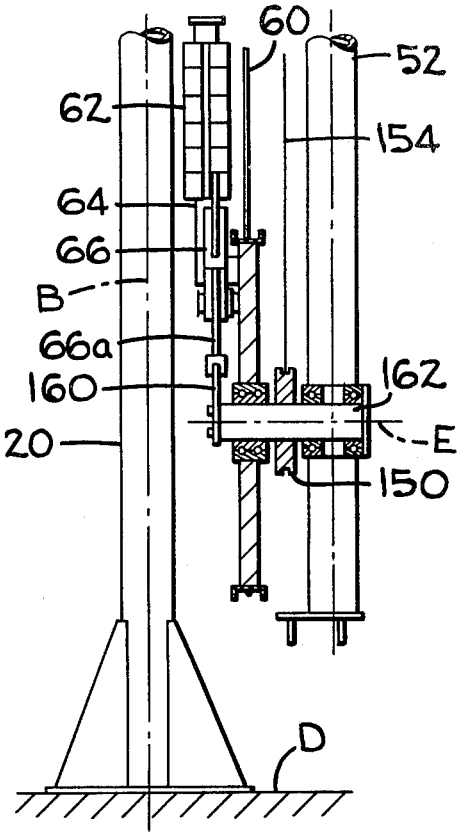
FIG_9
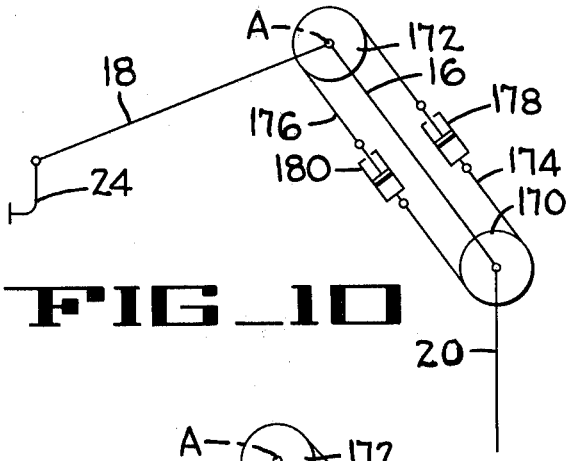
FIG_10
FIG_12
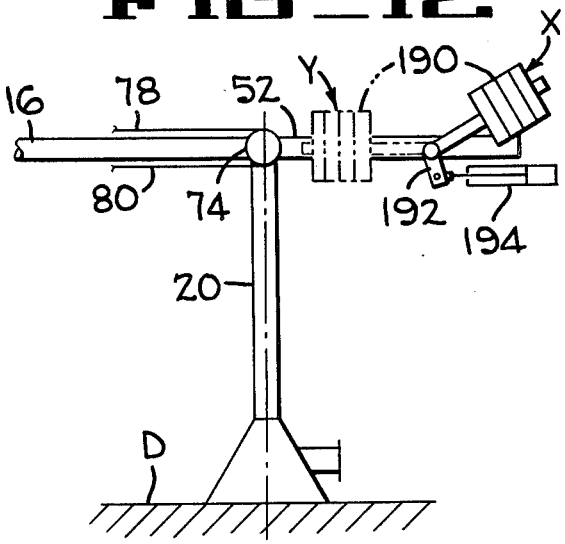
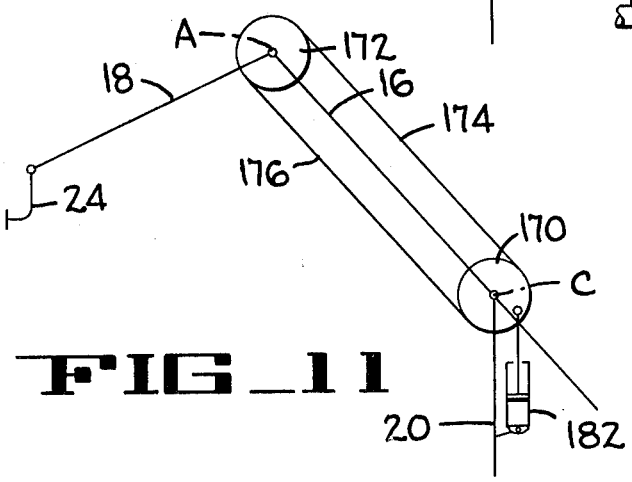
FIG_11

METHOD AND APPARATUS FOR CONTROLLING ARTICULATED FLUID LOADING ARMS UPON EMERGENCY DISCONNECTION

BACKGROUND OF THE INVENTION

1. Field of the Invention

The present invention relates to fluid handling apparatus, and more particularly to marine tanker loading arms with systems for counterbalancing the arm members.

2. Description of the Prior Art

Various types of fluid transferring devices are used in conveying fluids between a dock, buoy, or floating barge and a tanker or other marine transport vessel. Some of these devices are large articulated pipe structures referred to as marine loading arms, such an arm generally comprising an upstanding support riser on which is pivotally mounted an assembly of two or more arm members that are pivotally interconnected by swivel joints in a manner to allow the arm to accommodate itself to the movements of the buoy, barge and/or tanker while fluid transfer is in progress. Some examples of these earlier fluid transferring devices are described in U.S. Pat. Nos. 2,980,150, 3,382,892 and 3,805,834 to Bily, U.S. Pat. No. 3,581,769 to Haley, U.S. Pat. No. 3,889,728 to Riche, and U.S. Pat. No. 4,252,162 to LeDevehat.

It is common practice to install weights to counterbalance a loading arm about its horizontal pivot axis at the riser so that it can be more easily maneuvered. To achieve a balanced condition, some marine loading arms are provided with a support beam that is secured to the inner arm member and extends rearwardly therefrom behind the riser, and with a counterweight fixedly mounted on an inner sheave that is rotatably mounted on the support beam and connected by an endless cable to an outer sheave located at the juncture of the inner and outer arm members. The outer sheave is fixed to the outer arm member but rotatable with respect to the inner arm member, so that the counterweight, sheaves and cable function as a system to counterbalance the inner and outer arm members in all operating positions.

Although marine loading arms generally function satisfactorily, one of the problems sometimes encountered in their use is the difficulty associated with connecting them to a tanker or other vessel when they are in an unbalanced condition. Another problem is that some marine arms, when in either an over-balanced or under-balanced condition, have a tendency to move dangerously close to the tanker, and thus present a risk of impact or collision therewith, when they are disconnected from the tanker's manifold under emergency conditions. A further problem with some loading arm is that the curved path followed by the connection assembly at the outer end of the arm, when emergency disconnection is effected, sometimes results in collision between the arm and tanker, especially when the angle defined by the inner and outer arm members remains constant or changes too slowly after disconnection occurs.

SUMMARY OF THE INVENTION

The present invention overcomes the foregoing problems by providing a method and apparatus for controlling movement of a marine loading arm upon emergency disconnection thereof from a tanker or other marine vessel. In the illustrated embodiment of the invention, the arm comprises a rigid inner member mounted on an upstanding support riser for pivotal movement about a first horizontal axis, a rigid outer member pivotally connected at one of its ends to the outer end of the inner member for pivotal movement about a second horizontal axis, a hydraulic cylinder or other power means for controlling and pivoting the inner member about the first horizontal axis, a sheave and cable assembly extending between the inner and outer members for changing the attitude of the outer member with respect to the inner member independently of movement of said inner member, and a counterweight secured to the inner sheave of the sheave and cable assembly to counterbalance the inner and outer arm members in all of their operating positions.

The control system of the invention comprises an auxiliary counterweight, either slidably mounted on a support that is fixed to and extends rearwardly from the rear end of the inner arm member, or pivotally mounted on such support, and a hydro-mechanical system interconnecting the auxiliary counterweight and the arm to automatically and rapidly adjust the position of that counterweight, and thus correct the balance state of the arm, when a potentially dangerous or otherwise undesirable situation presents itself.

This control system is operable for adjusting the position of the auxiliary counterweight to balance the arm whether in an empty or filled condition, and whether the arm is connected to a tanker or other vessel or has undergone emergency disconnection therefrom. For example, in the event of emergency disconnection while the arm is full and the auxiliary counterweight is in its "balance filled" position, the inner arm member will pivot upwardly about the horizontal axis of its mounting on the support riser and the outer end of the arm will safely clear the tanker. If emergency disconnection occurs when the arm is empty, any significant out of balance of the inner arm member causes an increase in the hydraulic pressure that operates a hydraulic cylinder for pivoting the inner arm member, and this pressure increase is employed to actuate another hydraulic cylinder that adjusts the position of the auxiliary counterweight until arm balance has been recovered.

The hydro-mechanical system includes a hydraulic system interconnecting the arm's emergency disconnect device with the auxiliary counterweight, so that when the arm is connected to the tanker and the valve of the emergency disconnect device is opened the auxiliary counterweight is hydraulically repositioned into its "balance filled" location.

BRIEF DESCRIPTION OF THE DRAWINGS

FIGS. 7–11 illustrate various locations for the hydraulic cylinder that controls pivotal movement of the outer arm member about its connection to the inner arm member.

FIG. 12 is a diagrammatic fragmentary side elevation of a loading arm with another with another embodiment of hydraulically movable auxiliary counterweight according to the present invention.

DESCRIPTION OF THE PREFERRED EMBODIMENT

Figure 1:
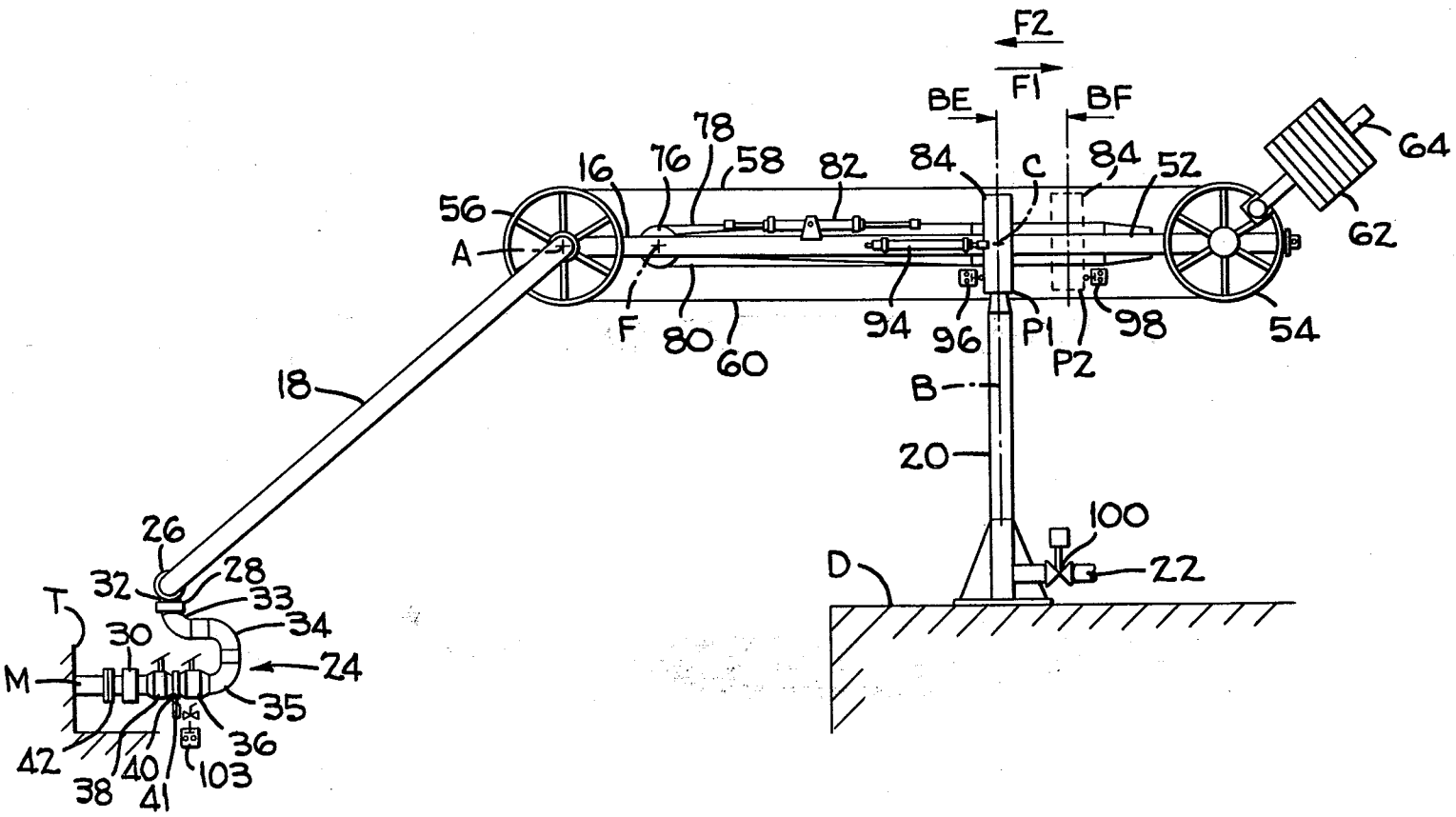
FIG. 1 is a diagrammatic side elevation of a fluid loading arm according to the present invention, with the arm mounted on a dock D and connected to an adjacent marine tanker T.

A fluid loading arm in accordance with the present invention comprises inner and outer arm members 16,18, respectively, these members being pivotally interconnected in substantially end-to-end relationship for relative movement about a horizontal axis A. The inner member 16 is pivotally mounted on an upstanding riser 20 for pivotal movement about intersecting vertical and horizontal axes B and C, respectively, and the riser 20 is shown mounted on a dock or other supporting structure D. The riser 20 is connected to a pipe line or other conduit 22 that extends to a fluid storage facility (not shown) for transferring fluid between that facility and the loading arm during loading or unloading operations.

The arm's outer member 18 carries at its outer end a multiple joint assembly 24 (FIG. 1) comprising three pipe swivel joints 26,28, and 30 oriented on mutually perpendicular axes and suitably interconnected by 90° pipe elbows 32,33,34 and 35, two flow control valves 36,38, and an emergency disconnect coupling 40 that is actuated by a hydraulic cylinder 41. The outer end of the swivel joint assembly 24 includes a flange 42 which can be brought into alignment with and connected to, a flange of a tanker manifold M to facilitate transfer of fluid from the loading arm to a tanker T. The swivel joint assembly 24 enables the loading arm to follow the movements of the marine tanker to which it is coupled so that fluid transfer can be safely and efficiently accomplished.

The inner arm member 16 is mounted on the riser 20 for pivotal movement about the vertical axis B and the horizontal axis C by pipe swivel joints 44,46 (FIG. 3), respectively, and 90° pipe elbows 48,50. The lower end of the elbow 48 is fixed to the outer or female element of the swivel joint 44, the upper end of the riser 20 is fixed to the inner or male element of the joint 48, and these inner and outer elements are rotatably interconnected by a plurality of bearing balls (not shown) in the conventional manner. The other or upper end of the pipe elbow 48 is fixed to the outer or female element of the swivel joint 46, the inner end of the inner arm elbow 50 is fixed to the inner or male element of the joint 46, and these inner and outer elements likewise are rotatably interconnected by a plurality of bearing balls (not shown). Behind the riser 20 is a beam or other suitable support structure 52 that is welded or otherwise fixed to the elbow 50 and the inner end of the inner arm member 16, and that extends rearwardly from and generally parallel to the arm member 16.

As illustrated in FIG. 1, the loading arm 10 is counterbalanced about the horizontal axis C by a first pantograph sheave and cable assembly comprising an inboard sheave 54, an outboard sheave 56, cables 58 and 60, and a counterweight 62. The inboard sheave 54 is mounted on the support 52 for pivotal movement about a horizontal axis E, and the counterweight 62 is secured to a counterweight beam 69 that is fixed to the sheave 54 and thus pivots therewith. The outboard sheave 56 is fixed to the outer arm member 18 coaxial with the axis A, and thus pivots about that axis in unison with the outboard member 18. The cables 58,60 are trained around the sheaves 54,56, and their inner ends are secured to the sheaves so that the rotation of either sheave causes like rotation of the other sheave, all in the conventional and well-known manner.

Pivotal movement of the outer arm member 18 with respect to the inner arm member 16 about the axis A can be accomplished by various conventional means including, for example, a hydraulic cylinder 66 (FIGS. 2 and 3) that is mounted by means of a bracket 68 on the support 52 and functionally connected to the sheave 54 by a crank arm 70 that is fixed to an axle 72 on which the sheave is secured. Thus, operation of the cylinder 66 rotates the sheave 54 about the axis E, and therefore the sheave 56 and outer arm member 18 about the axis A.

Pivotal movement of the inner arm member 16 about the horizontal axis C can be accomplished by operation of a second sheave and cable assembly comprising an inner sheave 74 secured to the outer race of the swivel joint 46 and thus non-rotatable about the axis C, an outer sheave 76 (FIG. 1) mounted on the inner arm member 16 and rotatable about a horizontal axis F, upper and lower cables 78,80 interconnecting the two sheaves 74,76, and a double-acting hydraulic cylinder 82 mounted on the inner arm member 16 and with its piston (not shown) connected to the cable 78. Accordingly, and in the conventional manner, operation of the cylinder 82 causes the inner arm member 16 to pivot up or down about the axis C.

Figure 4:
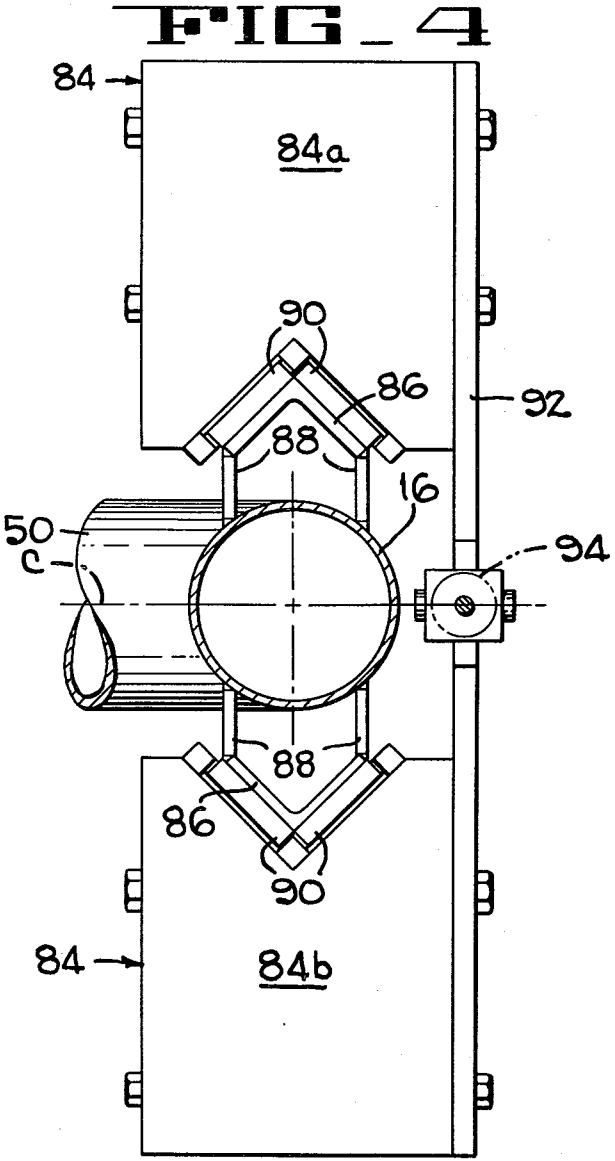
FIG. 4 is a view taken along the line 4—4 of FIG. 3, and on an enlarged scale, showing the auxiliary counterweight and the manner in which it is supported on the inner arm member.

In accordance with the invention, in order to remedy the above-mentioned problems, at least one hydraulically movable auxiliary counterweight 84 is provided on the support 52 that extends rearwardly from the rear end of the inner arm member 16. More precisely, the auxiliary counterweight 84 is slidably mounted on a track 86 (FIG. 4) secured by spacers 88 to the elbow 50 and the support 52, and rollers 90 facilitate this sliding movement. The counterweight 84 comprises two sections **84*a*,84*b* rigidly interconnected by a plate-like support 92, and these sections are moved in unison along the track 86 between the positions P1 and P2 (FIG. 1) by means of a hydraulic cylinder 94 that is mounted on the inner arm member 16 and functionally connected to the support 92**.

Figure 5:
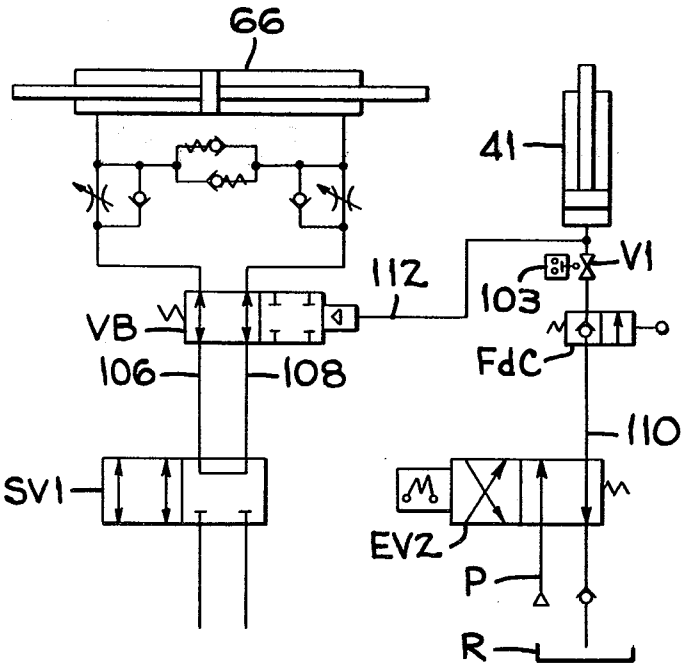
FIGS. 5 and 6 are schematic diagrams of the hydraulic system for controlling operation of the arm's hydraulic cylinders.
Figure 6:
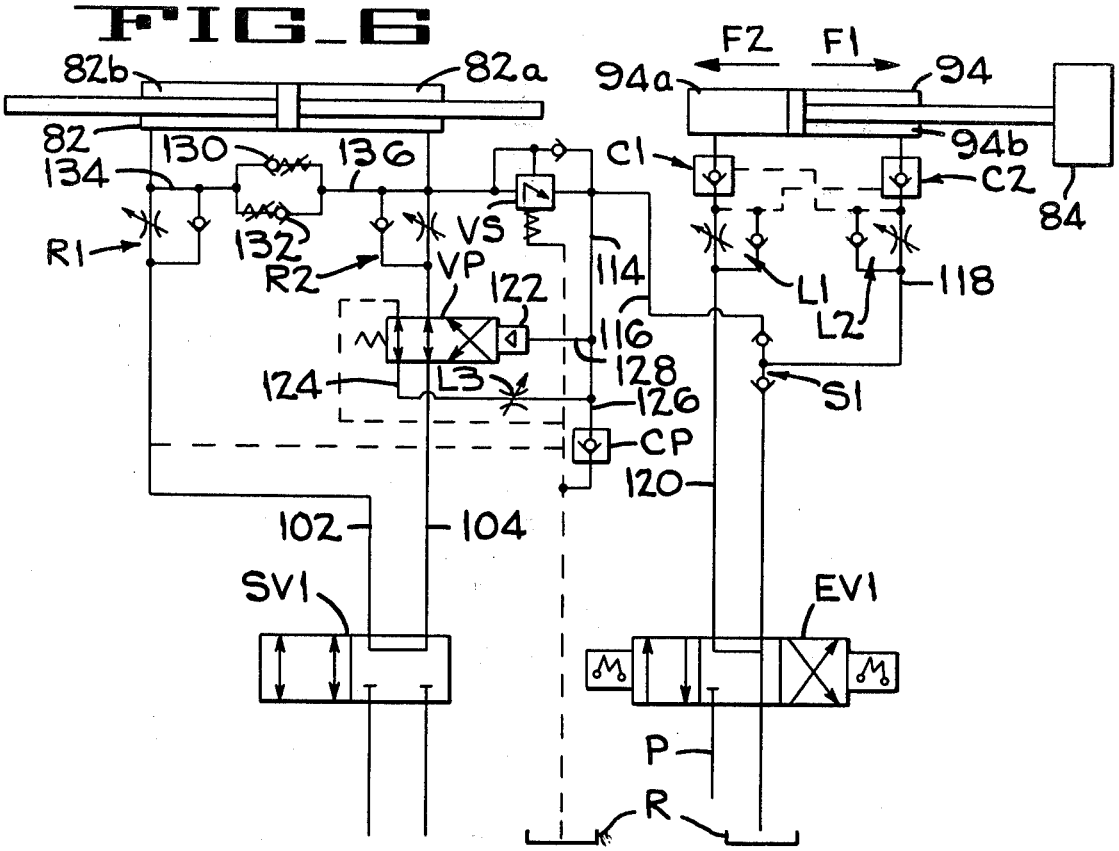

As is illustrated in FIGS. 5 and 6, the hydraulic cylinders 41,66,82 and 94 are controlled by a hydraulic system comprising a plurality of valves and other flow regulators interconnected in such a manner as to insure safe movement of the loading arm under all conditions, and especially following emergency disconnection thereof from a tanker T. The function of the components of this hydraulic system, and of the system as a whole, will become apparent from the following description of the operational steps involved in carrying out the method of the present invention.

OPERATION

The general operation of a fluid loading arm embodying the principles of the present invention is as follows.

In normal operation the arm is connected to the tanker manifold M with the auxiliary counterweight 84 in the "balanced empty" position BE (FIG. 1) as detected by a detector 96. After connection to the tanker has been accomplished a hydraulic lock valve V1 (FIG. 5) associated with the emergency disconnect device 40 is opened, thereby automatically causing displacement of the auxiliary counterweight 84 in the direction of the arrow F1 (FIG. 1) to its "balanced full" position BF wherein the arm when full is slightly overbalanced. When the counterweight 84 arrives at position BF it actuates a detector 98, thereby causing a flow control valve 100 in the pipe line 22 at the base of the arm to open.

Upon emergency disconnection of the arm when it is full and the auxiliary counterweight is in its BF position, since the arm is slightly over-balanced the inner arm member 16 will pivot upwardly about the axis C. Pressurizing the hydraulic cylinder 41 of the emergency disconnect device locks the outer arm member's hydraulic cylinder 66, thereby preventing the outer arm member from pivoting about the axis A and changing its position relative to the inner arm member 16.

Upon emergency disconnection of the arm when it is empty and the auxiliary counterweight is in its BF position, the unbalanced inner arm member 16 causes over-pressure in its hydraulic cylinder 82. This over-pressure opens the sequence valve VS (FIG. 6), thereby allowing hydraulic fluid to flow to the cylinder 94 to control displacement of the auxiliary counterweight. Consequently, as the inner arm member 16 pivots upwardly about the axis C the auxiliary counterweight 84 moves in the direction F2 until arm balance is re-established. The emergency disconnect device cylinder 41 is pressurized, thereby locking the outer arm member's cylinder 66 and thus preventing any change in angular relationship between the inner and outer arm members.

A more detailed operation of the hydraulic system is as follows:

Under normal circumstances, after connecting the loading arm to the tanker the operator opens valve V1 (FIG. 5) to lock the disconnect system. The electric detector 103 (FIG. 1) at the outer end of the arm automatically actuates an electric valve EV1 (FIG. 6) which opens to pressurize the auxiliary counterweight cylinder 94 to relocate the counterweight 84 in the direction F1 into its BF position. Flow limiting means L1 and L2 (FIG. 6) are employed to control the speed of movement of the counterweight 84, and check valve means C1 and C2 function to block the cylinder 94 in a fixed position in the event of failure in the hydraulic conduits. While the arm is connected to the tanker a selector valve SV1 (FIGS. 5 and 6) is in its illustrated condition wherein both chambers of the inner arm member's control cylinder 82 are in communication through hydraulic lines 102,104, and likewise both chambers of the outer arm member's control cylinder 66 are in communication through hydraulic lines 106,108.

In the event of an emergency an electric valve EV2 (FIG. 5) is switched on to admit hydraulic pressure to the line 110. With the valve FdC held open by a stop means (not shown), and with the valve V1 open, this hydraulic pressure actuates the cylinder 41 to cause disconnection of the arm. At the same time, this hydraulic pressure is conducted by line 112 to the valve VB, closing this valve and locking the cylinder 66, thereby preventing pivotal movement of the outer arm member 18 about the axis A.

It should be noted that, depending on the location chosen for the cylinder 66, the outer arm member 18 is locked either with respect to the inner arm member 16 or with respect to the riser 20.

With the emergency disconnect device open and the inner arm member 16 in a slightly over-balanced condition, the inner arm member pivots upwardly about the axis C at a speed that is controlled by a flow regulator R2 (FIG. 6). Pressure in the chamber **82*b* of the inner arm cylinder 82 being lower than the threshold pressure required to operate the sequence valve VS (FIG. 6), that valve remains closed and a piloted valve VP remains in the condition illustrated, whereupon fluid from chamber 82*b* flows back through selector valve SV1 to chamber 82*a*. When arm balance is achieved the upward motion of the inner arm member 16** ceases, whereby the inner arm member comes to rest in an attitude close to vertical.

Upon emergency disconnection when the arm is empty and the auxiliary counterweight is in its BF position, and when there is no detector showing whether the arm is filled or empty, the emergency disconnect device is open and the outer arm member 18 is locked in its attitude relative to the inner arm member 16. In this situation, since the flow regulator R2 (FIG. 6) restricts the flow of hydraulic fluid from the cylinder chamber **82*b* to a fixed amount the pressure in that chamber 82*b* is higher than the threshold pressure required to operate the sequence valve VS. The valve VS thereupon opens and allows pressure from cylinder chamber 82*b* to be conducted by line 114 to piloted valve VP, which valve VP moves from its illustrated position to its alternate position. Hydraulic pressure from the flow regulator R2 also is conducted through a line 116 to a direction selector valve S1, and then onward through a line 118 to a chmaber 94*b* of the cylinder 94, thereby to move the auxiliary counterweight 84 in the direction F2. The fluid in cylinder chamber 94*a* escapes to the reservoir R through line 120** and the electric valve EV1.

As the auxiliary counterweight 84 moves in the direction F2, the out-of-balance of the arm and the pressure in the inner arm cylinder chamber **82*b* are reduced. When that pressure drops below the threshold pressure required to operate the sequence valve VS, that valve closes but the upward pivotal movement of the inner arm member 16 slowly continues. Also, the valve VP remains in its controlled position (alternate to that illustrated) so that pressure from cylinder chamber 82*b* communicates with the pilot 122 of the valve VP through a line 124*a*, flow limiting means L3 and lines 126,128. During this the lines 116,118 supply pressure to the cylinder chamber 94*b* until the auxiliary counterweight 84** arrives at an arm-balanced position.

The change in state of the piloted valve VP occurs automatically when the operator controls the arm, since actually when pressure is applied through line 102 to cylinder chamber **82*a*, thereby tending to raise the inner arm member 16, pressurized fluid causes a piloted valve CP (FIG. 6) to open, thereby draining lines 126,128,114 to the reservoir R. This depressurizes the pilot 122 of valve VP, which valve then returns to its illustrated normal operating position in response to its return spring. During upward pivotal movement of the inner arm member 16 while the valve VP is in its alternate position in response to pressure on the pilot 122, hydraulic cylinder chamber 82*a*** communicates with the reservoir R through the valve VP.

As seen in FIG. 6, variable check valves 130, 132 interconnecting lines 134,136 provide intercommunication between the cylinder chambers **82*a*,82*b* when pressure therein exceeds the threshold pressure of these valves, thereby facilitating pivotal movement of the inner arm member 16** about the axis C in the event a deficiency in the operation of the above-described system occurs.

FURTHER EMBODIMENTS

Figure 2:
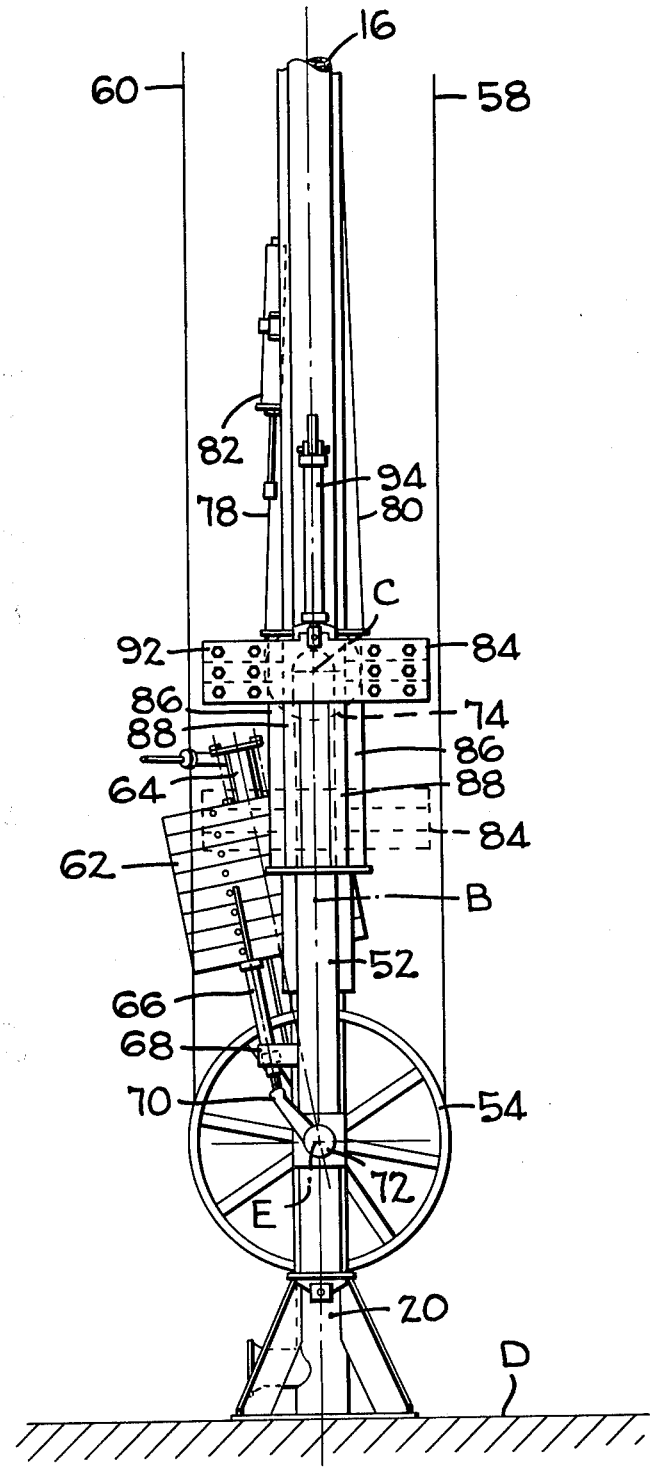
FIG. 2 is an enlarged fragmentary side elevation of the arm of FIG. 1, as viewed from the opposite side and with the arm's inner member in a vertical attitude.
Figure 3:
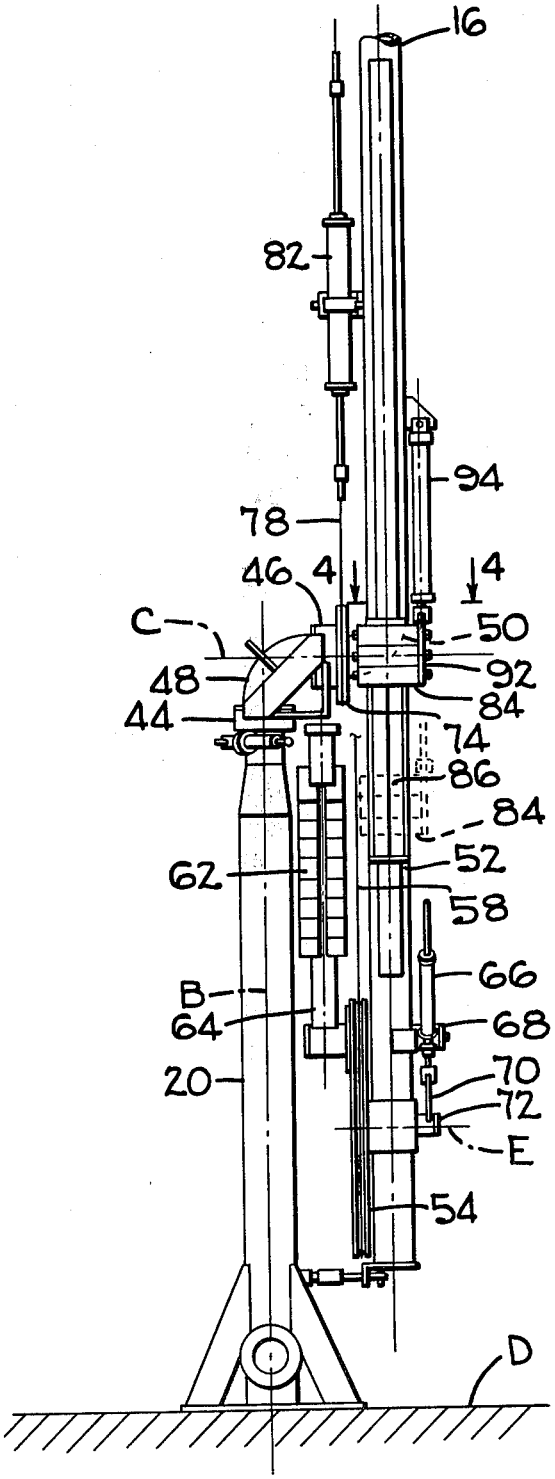
FIG. 3 is a fragmentary rear elevation of the arm as seen in FIG. 2.
Figure 7:
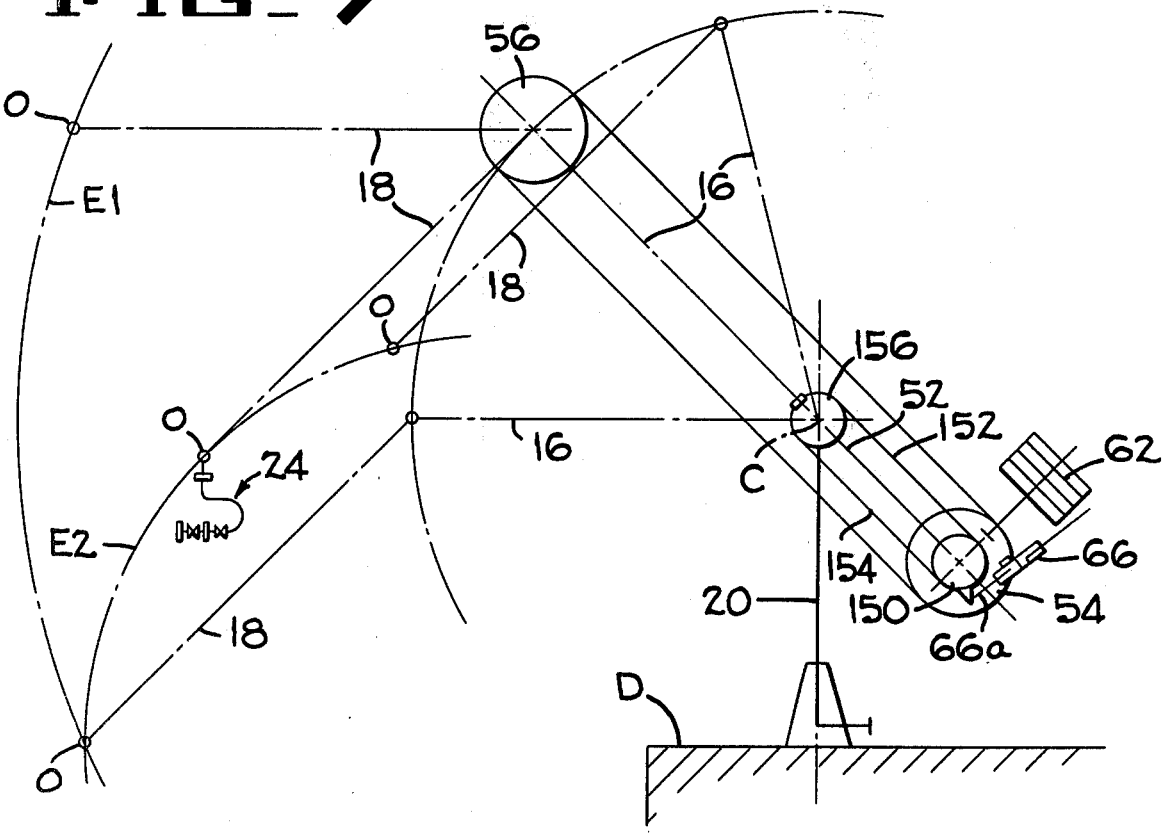

As diagrammatically illustrated in FIG. 7, upon emergency disconnection of the loading arm of FIGS. 1–3 from the tanker, and while the cylinder 66 is in its blocked condition, the outer end O of the outer arm member 18 follows an arcuate path E1 as the inner arm member 16 pivots upwardly about the axis C, since the outer arm member is prevented from changing its attitude relevant to the inner arm member. If, instead, the cylinder 66 is mounted on the sheave 54 as shown in FIG. 7 and in enlarged detail in FIG. 8, and its piston rod 66*a* is functionally connected to a pulley 150 that is mounted on the support 52 for rotation about the axis E, said pulley 150 being connected by cables 152,154 to another pulley 156 that is coaxial with the axis C but fixed against rotation thereabout, the attitude of the outer arm member 18 will remain constant with respect to the vertical as the inner arm member 16 pivots upwardly about the axis C. In this arrangement, the outer end O of the outer arm member 18 follows a curved path E2 as the arm pivots upwardly about axis C.

As illustrated in FIG. 9, and as an alternative to the arrangement shown in FIGS. 7 and 8, the cylinder 66 can be mounted for oscillatory motion on sheave 54 and its piston rod 66*a* connected to a crank arm or lever 160 that is fixed to the axle 162 on which the pulley 150 is fixedly mounted. It should be noted that this FIG. 9 arrangement differs from that of FIGS. 2 and 3 wherein the cylinder 66 is mounted on the support member 52.

FIGS. 10 and 11 illustrate optional conventional arrangements for controlling pivotal movement of the outer arm member 18 about the axis A. In FIG. 10 the loading arm is provided with a sheave and cable system comprising an inner sheave 170 fixedly mounted on the riser 20, an outer sheave 172 fixed to the outer arm member 18 and rotatable about the axis A, cables 174,176 interconnecting the sheaves 170,172, and hydraulic cylinder 178,180 functionally connected to the cables 174,176, respectively. In FIG. 11 only one cylinder 182 is employed, and it is mounted on the riser 20 and functionally connected to the inner sheave 170 which, in this arrangement, is mounted on the riser 20 for rotation about the axis C.

In the embodiment of the present invention illustrated in FIG. 12, an auxiliary counterweight 190, having the same function as its above described counterpart 84, is mounted on one end of a bell crank lever 192 whose apex is pivotally secured to the support member 52, and a hydraulic cylinder 194 for controlling the movement of the counterweight 190 is mounted on the support member 52 and functionally connected to the other end of the bell crank lever 192. The cylinder 194 controls the position and movement of the counterweight 190 in the same manner as the cylinder 66 controls the counterweight 84. The counterweight 190 is shown in two positions X and Y that substantially correspond to the positions BF and BE, respectively, of the corresponding counterweight 84 in the earlier described embodiments.

It should further be noted that, in accordance with the present invention, the hydraulic cylinder 94 (FIGS. 1–4) for moving the auxiliary counterweight 84 can be mounted on the support member 52 instead of on the inner arm member 16, if such is desired.

Although the best mode contemplated for carrying out the present invention has been herein shown and described, it will be apparent that modification and variation may be made without departing from what is regarded to be the subject matter of the invention.

What is claimed is:

1. An articulated loading arm for transferring fluid from one fluid handling means to another and for controlling movement of the outer end of the loading arm during emergency disconnection thereof from an adjacent fluid handling means, said arm comprising:

an inner arm member;

means mounting said inner arm member for pivotal movement about a first horizontal axis;

an outer arm member pivotally connected at one of its ends to the outer end of said inner arm member for movement about a second horizontal axis;

a first counterweight supported by said inner arm member and coupled to said outer arm member to counterbalance said loading arm about said first horizontal axis and said outer arm member about said second horizontal axis;

an auxiliary counterweight movably supported by said inner arm member for adjusting the entire loading arm about said first horizontal axis between a substantially balanced condition with the arm empty and a substantially balanced condition with the arm filled with fluid; and means for moving the auxiliary counterweight between positions wherein said substantially balanced conditions are achieved.

2. A loading arm as defined in claim 1 wherein said moving means comprises a hydro-mechanical system.

3. A loading arm as defined in claim 2 wherein said hydro-mechanical system includes hydraulic cylinder means interconnecting the auxiliary counterweight and the inner arm member.

4. A loading arm as defined in claim 2 wherein said hydro-mechanical system includes a hydraulic pressure system interconnecting the auxiliary counterweight and the inner and outer arm members.

5. A loading arm as defined in claim 4 wherein the hydraulic pressure system functions to actuate the auxiliary counterweight moving means in response to an out-of-balance condition of the arm about the first horizontal axis.

6. A loading arm according to claim 1 wherein said moving means functions to restore substantial balance of the arm about the first horizontal axis in response to emergency disconnection of the arm from another fluid handling means.

7. A loading arm as defined in claim 1 including means for detecting when the arm is in an unbalanced state, and means responsive to said detecting means to actuate said moving means.

8. A loading arm as defined in claim 1 including track means for slidably supporting said auxiliary counterweight, and hydraulic cylinder means for adjusting the position of said auxiliary counterweight on said track means.

9. A loading arm as defined in claim 8 including a hydro-mechanical system for actuating said hydraulic cylinder means in response to an out-of-balance condition of said arm.

10. A loading arm as defined in claim 9 wherein said hydro-mechanical system includes means to detect an out-of-balance condition of said arm, and means to accept a signal from said detect means and convey said signal to said hydraulic cylinder means.

11. A loading arm as defined in claim 1 including lever means for pivotally mounting said auxiliary counterweight on said arm, and hydraulic cylinder means for pivoting said lever means to adjust the position of said auxiliary counterweight.

12. A loading arm as defined in claim 1 including means for generating hydraulic pressure in the event of an out-of-balance arm condition, sequence valve means functionally connected to said hydraulic pressure generating means, and means interconnecting said sequence valve means to said auxiliary counterweight moving means.

13. A loading arm as defined in claim 12 including hydraulic cylinder means for controlling pivotal movement of the inner arm member, means interconnecting said sequence valve means and said hydraulic cylinder means, and means to actuate said sequence valve means in the event of emergency disconnection of the loading arm from another fluid handling means.

14. A loading arm as defined in claim 13 wherein said sequence valve actuation means comprises emergency disconnect means for disconnecting said loading arm from another fluid handling means in response to the occurrence of an undesirable relationship between said loading arm and said another fluid handling means.

15. A loading arm as defined in claim 1 including means to control the speed of movement of said auxiliary counterweight.

16. A loading arm as defined in claim 15 wherein said speed control means comprises at least one hydraulic flow control valve.

17. A loading arm as defined in claim 1 including hydraulic means to control the pivotal movement of said inner and outer arm members, and means to selectively block or unblock operation of said hydraulic means in order to prevent or facilitate said pivotal movement.

* * * * *